US005415320A

United States Patent [19]

North et al.

[11] Patent Number: 5,415,320

[45] Date of Patent: May 16, 1995

[54] UPRIGHT FACIAL TISSUE CARTON

[75] Inventors: Amie M. North, Appleton, Wis.; Troy M. Runge, Smyrna, Ga.; Linda M. Paulson, Pine River, Wis.

[73] Assignee: Kimberly-Clark Corporation, Neenah, Wis.

[21] Appl. No.: 125,043

[22] Filed: Sep. 20, 1993

[51] Int. Cl.[6] ..... B65H 1/00

[52] U.S. Cl. ..... 221/63; 206/233

[58] Field of Search ..... 221/63, 48, 45, 47; 206/812, 233

[56] References Cited

U.S. PATENT DOCUMENTS

| | | | |
|---|---|---|---|
| 2,849,152 | 8/1958 | Tuttle | 221/48 |
| 3,036,729 | 5/1962 | Asman | 221/48 |
| 3,083,866 | 4/1963 | Strange | 221/48 |
| 3,239,097 | 3/1966 | Bates et al. | 221/48 |
| 3,369,699 | 2/1968 | Enloe et al. | 221/48 |
| 3,979,019 | 9/1976 | Bliss | 221/48 |
| 4,356,950 | 11/1982 | Benham | 229/11 |
| 4,411,374 | 10/1983 | Hotchkiss | 221/63 |
| 4,678,099 | 7/1987 | Matsui | 221/48 |
| 4,768,679 | 9/1988 | Matsui | 221/48 |
| 4,785,970 | 11/1988 | Engelmayer | 221/47 |
| 4,863,064 | 9/1989 | Dailey, III | 221/48 |
| 4,877,154 | 10/1989 | Matsui | 221/48 |
| 5,219,421 | 6/1993 | Tipping | 221/63 |

FOREIGN PATENT DOCUMENTS

| | | | |
|---|---|---|---|
| 0577443 | 1/1994 | European Pat. Off. | B65D 83/08 |
| 1051417 | 12/1966 | United Kingdom . | |
| 1476303 | 6/1977 | United Kingdom | A47K 10/32 |
| 2119756 | 11/1983 | United Kingdom | B65D 75/58 |
| 2162825 | 2/1986 | United Kingdom | B65D 5/72 |

*Primary Examiner*—Kenneth W. Noland

*Attorney, Agent, or Firm*—Gregory E. Croft

[57] ABSTRACT

The tearing of tissues during dispensing from upright tissue cartons is reduced by providing the carton with a plastic film having a dispensing opening with an effective open area of about 3 square inches or greater. Dispensing openings formed by multiple intersecting slits provide improved dispensing while retaining an aesthetic pop-up presentation and protection of the tissues within the carton.

13 Claims, 4 Drawing Sheets

UPRIGHT FACIAL TISSUE CARTON

BACKGROUND OF THE INVENTION

Facial tissue cartons come in a wide variety of shapes and sizes, but they can generally be classified as either one of two basic styles. One style is the flat carton and the other is the upright carton. In the flat cartons, the tissues are laid flat in the bottom of the carton and are withdrawn from the top of the carton or through an opening in the top which partially extends down the front sidewall. The tissues within the carton may be interfolded for pop-up dispensing or merely laid on top of each other for reach-in dispensing. In the upright cartons, the tissues are folded into an inverted u-shaped clip and are interfolded for pop-up dispensing. The tissues are withdrawn through a dispensing opening in the top of the carton, which may contain a poly film having a slit to hold the popped up tissue in place.

The dispensing problems associated with flat cartons and upright cartons are distinctly different. With flat cartons, the major dispensing concern is usually "fall-back", which occurs as the tissue clip within the carton gets low and the distance from the uppermost tissue to the opening in the top of the carton gets longer. This can cause the tissue to fall back into the box rather than being retained by the opening for ready removal. On the other hand, fallback is not a problem for upright cartons because the inverted u-shaped clip maintains all of the tissues within the clip in close proximity to the top opening at all times. However, tearing of the tissue sheets upon removal from the carton is a concern because of the frictional forces and pressures associated with the inverted u-shaped clip being pressed up against the walls of the carton and the intra-tissue contact. These resistive forces can cause the tissues to tear as they are pulled through the dispensing opening. This is particularly true for the first few sheets dispensed after the carton is opened. The problem is lessened as the tissues within the carton are used up and the compression of the clip is reduced.

SUMMARY OF THE INVENTION

It has now been discovered that the occurrence of sheet tears upon removal from upright tissue dispensing cartons can be greatly reduced by appropriately modifying the dispensing opening.

In one aspect, the invention resides in an upright tissue carton containing a u-shaped clip of interfolded tissues, said carton having a top wall, four side walls and a bottom wall, said top wall having a carton opening overlaid with a flexible plastic film attached thereto, said plastic film having a dispensing opening through which the tissues are withdrawn from the carton and said dispensing opening having an effective open area of about 3 square inches or greater, more specifically from about 3 to about 16 square inches, and still more specifically of from about 3 to about 6 square inches. The "effective" open area is the area available for the tissue sheet to pass through the plastic film. The effective open area not only includes any "actual" open area or holes in the plastic film, but also includes open areas created by opening flaps in the plastic film which are otherwise closed. Such flaps are formed by multiple slits in the plastic film as will be hereinafter illustrated. The area defined by an imaginary line connecting the ends of all of the slits is the "effective" open area. Preferably, the effective open area of the dispensing opening is greater than the actual open area of the dispensing opening. It is also preferred that the actual open area of the dispensing opening be from about 0 to about 2 square inches or less, more preferably about 1 square inch or less.

In another aspect, the invention resides in an upright tissue carton containing a u-shaped clip of interfolded tissues, said carton having a top wall, four side walls and a bottom wall, said top wall having a carton opening overlaid with a flexible plastic film attached thereto, said plastic film having a dispensing opening through which the tissues are withdrawn from the carton, said dispensing opening comprising two or more intersecting slits which provide an effective open area of about 2 square inches or more, more specifically from about 5 to about 16 square inches.

For purposes herein, the flexible plastic film is preferably sufficiently flexible so as to offer minimal resistance to the tissues as they are withdrawn through the dispensing opening. Suitable plastic films include polyethylene films having a thickness of about 3 mil or less, more suitably about 2 mil or less. The suitability of a plastic film or other material for use in connection with this invention can be determined by the Federal Test Method Standard No. 191, Method 5206.1 (Jul. 10, 1970) entitled "Stiffness of Cloth, Drape and Flex; Cantilever Bending Method" and using a TMI FRL Cantilever Bend Tester ®. The results are reported as bending length or drape stiffness. Plastic films for use herein preferably have a drape stiffness of about 3 inches or less, more preferably about 2 inches or less. A polyethylene film having a basis weight of about 35 grams per square and a drape stiffness of about 1.6 inches is particularly suitable. A highly drapeable or flexible material is particularly important with respect to the concept of effective open area, as will hereinafter be described. Other materials such as cardboard and paper which have very high drape stiffness values are too stiff and offer too much resistance to the sheets as they are dispensed.

It is within the scope of this invention that the shape of the dispensing opening can be irregular and/or unsymmetrical, although symmetrical openings are satisfactory. Dispensing openings having two or three or more slits centrally located within the carton opening and which intersect at approximately their midpoints work particularly well. The slits can be straight or curvilinear. As will be shown herein, two intersecting slits which intersect at an acute angle in the form of an "x" or intersect at right angles to form a "cross" work well. The x-shaped dispensing opening is preferred because it extends closer to the corners of the carton. This effectively decreases the distance the corners of the tissue have to travel to leave the carton, which is believed to be an important factor in reducing sheet tears. As will also be illustrated herein, some of the v-shaped flaps between the intersecting slits can also be removed if desired to provide a dispensing opening which has an "actual" open area as distinguished from the larger "effective" open area defined by the ends of the slits. However, it is preferable to retain at least two of such flaps to deaden the scratching noise which otherwise accompanies withdrawal of a tissue from a totally open dispensing opening. A dispensing opening having a small "actual" open area is also preferred for cleanliness and protecting the tissues within the carton.

The width of the dispensing opening, which is the maximum dimension of the effective open area as measured parallel to the cross-machine direction of the tissues within the carton, must be about 1 inch or greater, suitably from about 1 to about 4 inches, and more specifically from about 1.5 to about 3 inches. It is believed that an optimum dispensing opening width not only takes into account the need for a sufficiently large opening to reduce frictional and drag forces on the tissue, but also avoids overly reducing the carton stacking strength by eliminating too much of the cardboard in the top wall of the carton.

The length of the dispensing opening, which is the maximum dimension of the effective open area measured parallel to the machine direction of the tissues within the carton, can be about 2.5 inches or greater, preferably from about 3 inches to about 4 inches. Dispensing opening lengths of less than about 2.5 inches would be expected to cause greater amounts of sheet tears. The maximum length of the dispensing opening is limited by the dimensions of the carton opening, which in turn is limited by the dimensions of the top of the carton. In all cases, it is preferred that the dispensing opening be sufficiently smaller than the carton opening so that the tissue sheets only contact the plastic film during dispensing, rather than contacting the edge of the carton opening. Contact with the carton opening will create greater friction and linting due to the relatively rough edges and thickness of the carton material.

The carton opening is preferably as large as possible consistent with the stacking strength requirements and carton aesthetics. Oval carton openings have gained acceptance in the field on a commercial basis. However, for purposes of this invention, other carton opening shapes can also be used and may be even more effective in reducing sheet tears. Square or rectangular carton openings, for example, can provide a shorter dispensing length of travel for the corners of the tissue if the dispensing opening is also extended toward the corners of the carton opening. Hence such carton openings may provide better dispensing compared to oval-shaped carton openings. Irregular shapes which extend toward the corners of the carton can also be used effectively. The cartons of this invention suitably have a carton opening area of about 6 square inches or greater, more specifically from about 6 to about 16 square inches or greater, and still more specifically from about 7 to about 12 square inches. For oval-shaped carton openings, the width of the carton opening in the cross-machine direction of the tissues within the carton is preferably from about 2 inches to about 3 inches and more preferably from about 2.25 inches to about 2.75 inches taking stacking strength and aesthetics into account. The area of the oval carton openings is preferably from about 6 to about 16 square inches.

Besides the factors outlined above, it will be appreciated that there are a large number of other factors which also contribute to sheet tearing during dispensing, including sheet and clip characteristics. Examples of sheet characteristics include the coefficient of friction, the cross-machine direction (CD) tensile strength, the bulk of the tissue, the length of the tissue, the quality of the crimp holding the tissue plies together, whether the tissue is blended or layered, and so on. Clip quality and clip compression also can play a role. Hence in making comparisons of the ease of dispensing for a given dispensing opening, it is essential that the same tissue sheets be used in all cases.

DETAILED DESCRIPTION OF THE DRAWING

Figure 1:
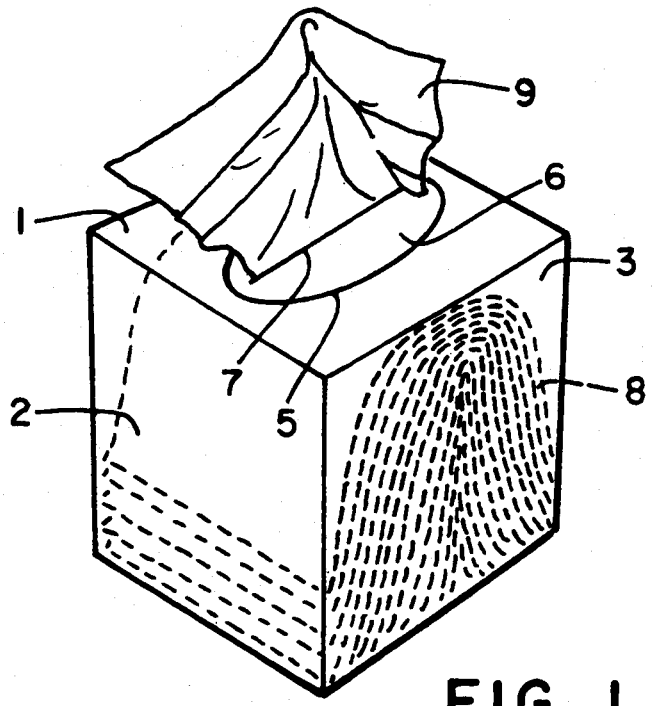
FIG. 1 (PRIOR ART)
FIG. 1 is a perspective view of a prior art upright facial tissue carton having a dispensing opening consisting of a single straight slit aligned in the machine direction of the tissues within the carton.

Referring to FIG. 1, shown is a perspective view of a commercially available upright facial tissue carton having a top wall 1, a bottom wall (not shown), and four sidewalls (sidewalls 2 and 3 shown). The top wall contains an oval carton opening 5 overlaid with a plastic film 6 having a dispensing opening in the form of a single slit 7. Within the carton is an inverted u-shaped clip of interfolded tissues 8 indicated by the phantom lines. The machine direction of the tissues within the clip, as viewed from the top of the carton, is parallel to the direction of the dispensing opening slit. During dispensing, the top tissue in the clip is grasped by the user and is withdrawn through the slit. Removal of the top tissue causes the adjacent interfolded tissue, next in line to be dispensed, to be partially pulled through the slit. The partially dispensed tissue 9 is held in a popped-up position by the edges of the slit.

Figure 2:
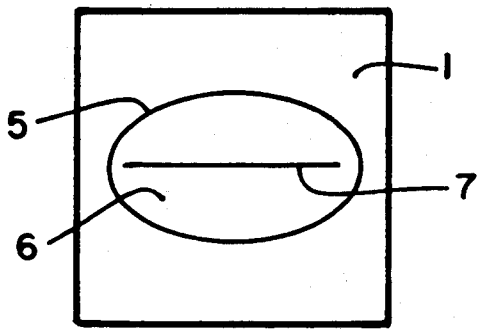
FIG. 2 (PRIOR ART)
FIG. 2 is a plan view of the carton of FIG. 1, further illustrating the dispensing opening.

FIG. 2 is a plan view of the carton of FIG. 1, further illustrating the relative dimensions of the carton opening and the dispensing opening. Specifically, the oval carton opening 5 is 3.5 inches long and 2.25 inches wide. The slit 7 is 3.25 inches long.

Figure 3:
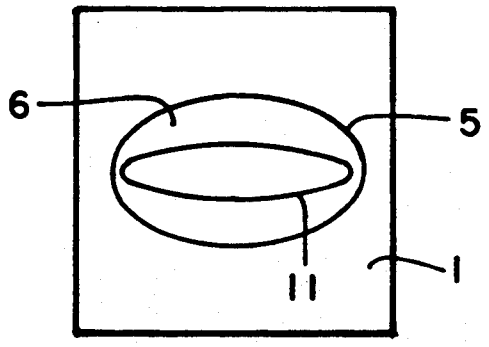
FIG. 3 (PRIOR ART)
FIG. 3 is a plan view of another prior art upright facial tissue carton which has a dispensing opening consisting of a narrow oval-shaped opening aligned in the machine direction of the tissues within the carton.

FIG. 3 is a plan view of another commercially available upright facial tissue carton. As with the carton described above, this carton also has an oval carton opening in the top wall of the carton which is overlaid with a plastic film. Compared to the carton illustrated in FIG. 1, the plastic film of this carton is provided with an open dispensing opening 11 having a length of 3.5 inches and a width of 0.75 inch (actual open area of about 2 square inches). The oval carton opening has a length of about 3.75 inches and a width of about 2.125 inches (area of about 6.26 square inches).

Figure 4:
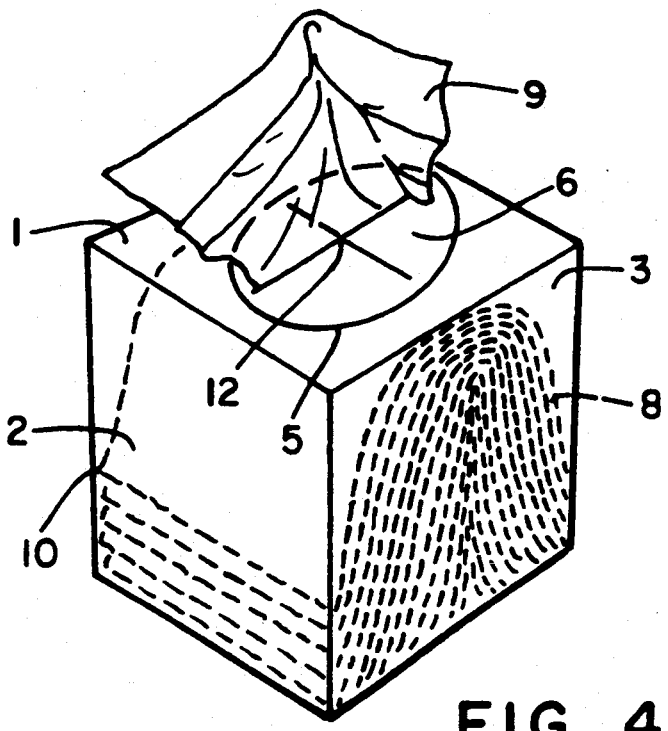
FIG. 4 is a perspective view of an upright facial tissue carton of this invention having a dispensing opening consisting of a cross-shaped slit.

FIG. 4 is a perspective view of an upright facial tissue carton in accordance with this invention. As with the carton illustrated in FIG. 1, shown is the top wall 1, sidewalls 2 and 3, an oval carton opening 5, and a plastic film 6 overlying the carton opening. The plastic film is adhered to the inside of the top wall with a suitable adhesive. Not shown are the remaining two sidewalls and the bottom wall. In this embodiment, the plastic film contains a cross-shaped slit 12 through which the inverted u-shaped clip of tissues 8 is dispensed. As with the carton of FIG. 1, the tissue 9 is held in a popped-up position for easy dispensing. As will be discussed hereinafter, the distance of travel of the corners of the tissues (such as corner 10) during dispensing is a factor contributing to the number of sheet tears. It is desireable to minimize the distance between the corners of the tissues and the dispensing opening.

Figure 5:
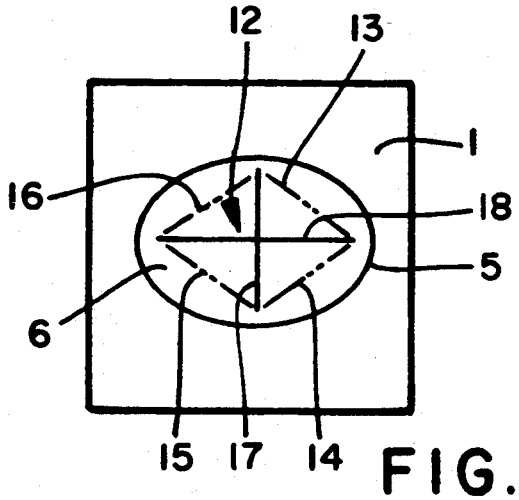
FIG. 5 is a plan view of the carton of FIG. 4, further illustrating the dispensing opening.

FIG. 5 is a plan view of the carton of FIG. 4, further illustrating the dispensing opening. Shown is the top 1 of the carton, the oval carton opening 5, the plastic film 6, and the cross-shaped dispensing opening 12 centrally located within the carton opening. For purposes herein, this particular dispensing opening has no "actual" open area because the slits are very thin and there are no open holes in the plastic film. However, this dispensing opening has an "effective" open area defined as the area within the dashed lines 13, 14, 15 and 16 which connect the ends of the slits to form a parallelogram. These dashed lines also approximate the fold lines of the plastic film when a tissue is withdrawn through the opening. Because the plastic film offers no substantial resistance-to the tissue as it is withdrawn, the entire area within the dashed lines is effectively an open area. Yet at the same time, the edges of the slits provide the function of gently constricting the partially dispensed tissue to maintain the popped-up configuration. In this embodiment, the maximum width of the dispensing opening is the length of the cross slit 17, which is aligned parallel to the cross-machine direction of the tissues within the carton. The longer slit 18 is aligned parallel to the machine direction of the tissues within the carton and represents the length of the dispensing opening.

Figure 6:
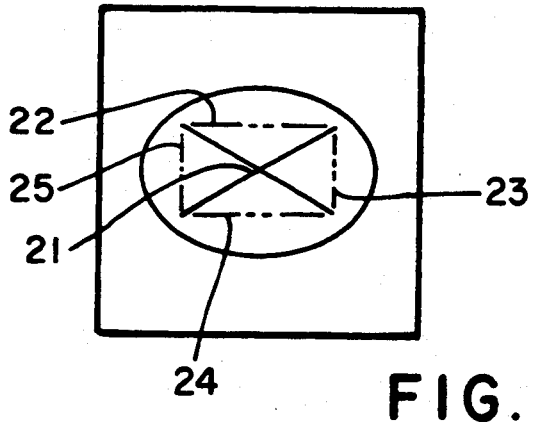
FIG. 6 is a plan view of an upright facial tissue carton of this invention having an x-shaped dispensing opening.

FIG. 6 is a plan view of a tissue carton of this invention similar to that of FIG. 5, but illustrating an x-shaped dispensing opening 21. The effective area of the dispensing opening is defined by the dashed lines 22, 23, 24 and 25. As shown, the dispensing opening is essentially formed by two intersecting slits which intersect at an angle of about 50°. In this embodiment, the maximum width of the dispensing opening is the distance between the ends of the two slits as represented by the length of dashed lines 23 and 25. As is apparent from the drawing, the distance which the corners of the tissue must travel to reach the dispensing opening is minimized by the x-shaped slits which extend toward the corners of the carton.

Figure 7:
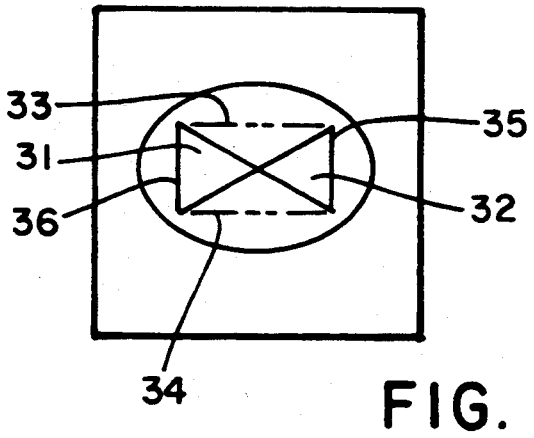
FIG. 7 is a plan view of an upright facial tissue carton of this invention having a "bow tie" shaped dispensing opening.

FIG. 7 is a plan view of another tissue carton of this invention similar to that of FIG. 6, but having a "bow tie" shaped dispensing opening. In this embodiment, the two v-shaped flaps 31 and 32 formed by the intersecting slits are completely cut out of the plastic film to form the "actual" open area of the dispensing opening. The "effective" open area is larger than the actual open area and is the area defined by the bounded by dashed lines 33 and 34 and the edges 35 and 36 of the open area. This embodiment is advantageous because the removal of the v-shaped flaps to create the two open areas is believed to be more aesthetically appealing during use. As with the embodiment illustrated in FIG. 6, the width of the dispensing opening for this embodiment is measured by the length of edges 35 and 36.

Figure 8:
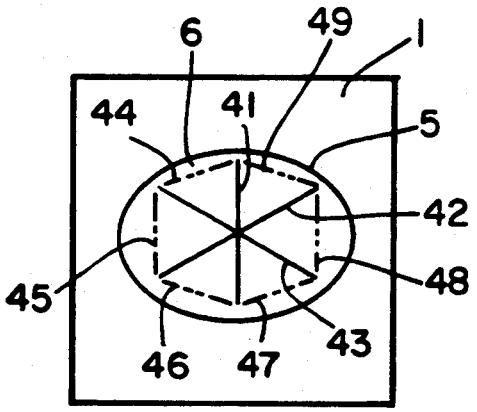
FIG. 8 is a plan view of an upright facial tissue carton of this invention having a dispensing opening comprising three intersecting slits.

FIG. 8 is a plan view of another embodiment of a tissue carton in accordance with this invention. This carton has an oval carton opening 5 and a dispensing opening defined by three intersecting slits 41, 42, and 43. The effective area is defined by the area within the dashed lines 44, 45, 46, 47, 48 and 49. This embodiment provides a slightly larger effective open area than the embodiment illustrated in FIG. 7.

Figure 9:
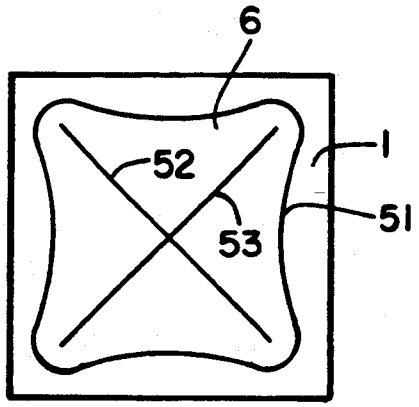
FIG. 9 is a plan view of an upright facial tissue carton of this invention having a "soft" square carton opening and an x-shaped dispensing opening in which the slits extend close to the corners of the carton.

FIG. 9 is a plan view of another embodiment of a tissue carton in accordance with this invention. This carton is provided with a "soft" or curvilinear square carton opening 51. The plastic film is provided with an x-shaped dispensing opening having two intersecting slits 52 and 53 and has an effective open area slightly less than the area of the top wall of the carton, or about 16 square inches if applied to typical commercially available upright cartons which measure about 4.5 inches on a side.

Figure 10:
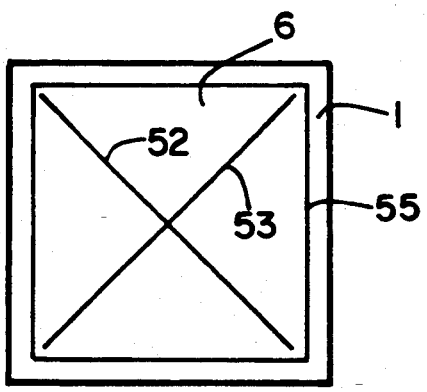
FIG. 10 is a plan view of an upright facial tissue carton of this invention having a square carton opening and an x-shaped dispensing opening similar to that of FIG. 9.

FIG. 10 is a plan view of-another embodiment of a tissue carton in accordance with this invention similar to that of FIG. 9, but having a straight square carton opening 55.

Referring to the Examples below, the invention will be described in further detail.

EXAMPLES

Example 1

In order to illustrate the improved dispensing provided by the carton openings of this invention, a number of different carton and dispensing openings were tested for sheet tears. More particularly, upright facial tissue cartons containing a conventional straight slit dispensing opening were compared to cartons having an x-shaped dispensing opening and a cross-shaped dispensing opening, all with three different sizes of oval carton openings. Specifically, the test samples were as follows: Sample A, as shown in FIG. 2, having a straight slit length of 3.25 inches and an oval carton opening having a length of 3.5 inches, a width of 2.25 inches and an area of about 6.2 square inches. (This carton opening is designated herein as the "current" oval carton opening because it is the size being used in current commercially available upright cartons of Kleenex® facial tissues); Sample B, as shown in FIG. 6, having an oval carton opening the same as Sample A and having an x-shaped dispensing opening with 3.0 inch slits intersecting at an angle of about 37° to provide a dispensing opening width of about 1 inch and having an effective open area of about 3 square inches; Sample C, as shown in FIG. 5, having an oval carton opening the same as Sample A and having a cross-shaped dispensing opening with a lengthwise slit of 3.25 inches and a cross slit of 2.0 inches (the dispensing opening width) and an effective open area of about 3.25 inches; Sample D, having a straight slit dispensing opening length of about 3.3 inches and an oval carton opening measuring 3.5 inches by 2.63 inches and having a carton opening area of about 7.2 square inches (herein referred to as the "medium" oval carton opening); Sample E, having the same oval carton opening of Sample D, but having an x-shaped dispensing opening with 3.0 inch slits intersecting at an angle of about 50° to provide a dispensing opening width of about 1.3 inches and an effective area of 3.6 square inches; Sample F, having the same oval carton opening of Sample D, but having a cross-shaped dispensing opening with a lengthwise slit of 3.25 inches and a cross slit of 2.5 inches (the dispensing opening width) and an effective open area of about 4.1 square inches; Sample G, having a straight slit dispensing opening having a length of about 3.38 inches and an oval carton opening having a length of 3.5 inches, a width of 3 inches and a carton opening area of about 8.24 square inches (herein referred to as the "large" oval carton opening); Sample H, having the same oval carton opening of Sample G, but having an x-shaped dispensing opening having 3.0 inch slits intersecting at an angle of about 84° to provide a dispensing opening width of about 2 inches and an effective open area of about 6 square inches; and Sample I, having the same oval carton opening of Sample G, but having a cross-shaped opening with a lengthwise slit of 3.25 inches, a cross slit of 2.9 inches (the dispensing opening width) and an effective open area of about 4.7 square inches.

All of the sample cartons were hand packed with clips of interfolded two-ply Kleenex® Softique® tissues. All of the cartons were packed at the same time, but the order in which they were packed was randomized. When all of the sample cartons were filled with tissues, two experimenters (designated Exp 1 and Exp 2) dispensed 20 tissues from 15 cartons of each sample type and noted if the tissues tore on removal from the carton. The first two sheets .dispensed from the cartons were not counted because the tissue clips within the cartons were interfolded so that the first two tissues dispensed together. The results are set forth below in Table 1. In the Table, the "cross" represents the cross-shaped opening, the "x" represents the x-shaped opening, and "line" represents the straight slit dispensing opening.

TABLE 1

| Sample | Carton Opening | Dispensing Opening | (Tissue Tears During Dispensing) Tears (Exp 1) | Tears (Exp 2) | Total Tears | Tears per Carton |
|---|---|---|---|---|---|---|
| A | current | line | 21 | 12 | 33 | 1.65 |
| B | current | x | 2 | 1 | 3 | 0.15 |
| C | current | cross | 4 | 3 | 7 | 0.35 |
| D | medium | line | 7 | 5 | 12 | 0.60 |
| E | medium | x | 3 | 1 | 4 | 0.20 |
| F | medium | cross | 3 | 3 | 6 | 0.30 |
| G | large | line | 16 | 10 | 26 | 1.30 |
| H | large | x | 7 | 2 | 9 | 0.45 |
| I | large | cross | 0 | 1 | 1 | 0.05 |

The results show that the x-shaped dispensing opening and the cross-shaped dispensing opening are statistically better than the straight slit dispensing opening, although there is no statistical difference between the x-shaped opening and the cross-shaped opening for this sample size without being bound to any theory, it is believed that the dispensing of the tissues is improved When the corners of the tissue sheet within the carton are provided with a shorter path during dispensing, since the corners must travel the greatest distance and are therefore more likely to catch or wrap around the underlying tissue. Increasing the width of the dispensing opening and the effective area of the dispensing opening shortens the travel path of the corners of the tissues and hence reduces the tendency to tear.

Example 2

In order to further illustrate the benefits of the dispensing openings of this invention, additional dispensing testing was performed using a larger sample size and using commercial 2-ply facial tissues produced at different mill locations (designated Mill #1 and Mill #2). Tissues produced on different tissue machines at different locations inherently possess subtly different dispensing properties. More specifically, the first 20 tissues were removed from 900 upright facial tissue cartons made at each mill location. Each carton initially contained 90 tissues. The carton openings tested were the current oval and the medium oval as described above. The dispensing openings tested were the single line slit opening (control), the x-shaped opening and the cross-shaped opening as described above. The number of sheet tears for each carton were noted and the results averaged for each carton design. The results are set forth in Table 2 below.

TABLE 2

| Mill | Carton Opening | Dispensing Opening | Average Tears per Carton |
|---|---|---|---|
| 1 | current | line | 1.96 |
| 1 | current | x | 0.83 |
| 1 | current | cross | 1.28 |
| 1 | medium | x | 0.88 |
| 1 | medium | cross | 0.88 |
| 2 | current | line | 2.99 |
| 2 | current | x | 1.41 |
| 2 | current | cross | 1.98 |
| 2 | medium | x | 0.99 |
| 2 | medium | cross | 1.18 |

Example 3

To further illustrate the advantages of the carton opening designs of this invention, commercially available cartons as illustrated in FIG. 3 were tested for dispensing tears using two different tissue basesheets (designated type 1 and type 2). One test carton was the carton as illustrated in FIG. 3 containing the tissues normally sold in such cartons (tissue type 1). The second test carton was also the carton of FIG. 3, but containing different tissues (tissue type 2). The third carton was a carton of this invention having the current oval with the x-shaped opening and containing type 1 tissues. Twenty cartons of each design were filled with commercially available tissues. The first twenty tissues from each carton were dispensed and the number of tears noted. The results are set forth in Table 3.

TABLE 3

| Sheet Count | Tissue Type | Carton Opening | Dispensing Opening | Average Tears per Carton |
|---|---|---|---|---|
| 95 | 1 | FIG. 3 | FIG. 3 | 0.85 |
| 90 | 2 | FIG. 3 | FIG. 3 | 2.45 |
| 95 | 1 | current | x | 0.15 |

These results further illustrate the improved dispensing of the 15 cartons of this invention. When compared to the data in the previous examples, these results also illustrate the pronounced effect that the properties of the tissue sheet have on the number of tears which occur during dispensing.

It will be appreciated that the foregoing examples, given for purposes of illustration, are not to be construed as limiting the scope of this invention, which is defined by the following claims and all equivalents thereto.

We claim:

1. An upright tissue carton containing a u-shaped clip of interfolded tissues, said carton having a top wall, four side walls and a bottom wall, said top wall having a carton opening overlaid with a flexible plastic film attached to the top wall, and said plastic film having a dispensing opening through which the tissues are withdrawn from the carton, said dispensing opening having an effective open area of about 3 square inches or greater.

2. The carton of claim 1 wherein the dispensing opening has an effective open area of from about 3 to about 16 square inches.

3. The carton of claim 1 wherein the dispensing opening has an effective area of from about 3 to about 6 square inches.

4. The carton of claim 1 wherein the dispensing opening has an actual open area of about 2 square inches or less.

5. The carton of claim 1 having a dispensing opening having an actual open area and wherein the effective open area of the dispensing opening is larger than the actual open area.

6. The carton of claim 1 having an oval carton opening.

7. The carton of claim 1 having a square carton opening.

8. The carton of claim 1 having a carton opening of from about 7 to about 16 square inches.

9. The carton of claim 1 wherein the dispensing opening comprises intersecting slits.

10. The carton of claim 9 wherein there are two slits which intersect at an acute angle to form an x-shaped dispensing opening.

11. The carton of claim 9 wherein there are two slits which intersect to form a cross-shaped dispensing opening.

12. The carton of claim 9 wherein there are three intersecting slits.

13. An upright tissue carton containing a u-shaped clip of interfolded tissues, said carton having a top wall, four side walls and a bottom wall, said top wall having a carton opening having an area of from about 7 to about 16 square inches overlaid with a plastic film attached to the top wall, said plastic film having a dispensing opening through which the tissues are withdrawn from the carton, said dispensing opening having an effective open area of from about 3 to about 16 square inches and comprising two or more intersecting slits.

* * * * *